US006027408A

United States Patent [19]

Star

[11] Patent Number: 6,027,408

[45] Date of Patent: Feb. 22, 2000

[54] INTERACTIVE PROBE GAME

[76] Inventor: Jack Star, 575 Price Ave., Redwood City, Calif. 94063

[21] Appl. No.: 08/755,002

[22] Filed: Nov. 22, 1996

Related U.S. Application Data

[63] Continuation of application No. 08/336,871, Nov. 9, 1994, abandoned.

[51] Int. Cl.[7] ..... G08B 13/24

[52] U.S. Cl. ..... 463/39; 333/175; 333/185; 340/572

[58] Field of Search ..... 333/175, 185; 340/572; 343/731; 463/39

[56] References Cited

U.S. PATENT DOCUMENTS

| | | | |
|---|---|---|---|
| 2,124,211 | 7/1938 | Roberts | 333/175 |
| 2,617,936 | 11/1952 | Cohn | 343/909 |
| 3,766,452 | 10/1973 | Burpee et al. | 317/262 R |
| 3,820,041 | 6/1974 | Gewostowski | 333/24 C |
| 4,126,837 | 11/1978 | Koyamada et al. | 333/72 |
| 4,598,276 | 7/1986 | Tait | 333/185 |
| 4,843,404 | 6/1989 | Benge et al. | 333/185 |
| 5,276,398 | 1/1994 | Withers et al. | 324/318 |
| 5,291,180 | 3/1994 | Reeb | 340/572 |

FOREIGN PATENT DOCUMENTS

| | | | |
|---|---|---|---|
| 186107 | 9/1985 | Japan | 333/185 |
| 163409 | 7/1987 | Japan | 333/185 |
| 4014176 | 6/1994 | WIPO | 333/175 |

*Primary Examiner*—Jessica J. Harrison
*Assistant Examiner*—James Schaaf
*Attorney, Agent, or Firm*—John E. Wagner

[57] ABSTRACT

An interactive game is disclosed which may take the form of a board game, a hand held game or a yard game. It includes a series of printed circuits or devices which may be concealed within a playing surface and an electronic detector for the circuits. Easily as many as 8 or 16 different discrete device may be detected and distinguished. Stored messages associated with each device or combinations of devices is displayed or audibly reproduce the messages.

11 Claims, 15 Drawing Sheets

FIG. 4
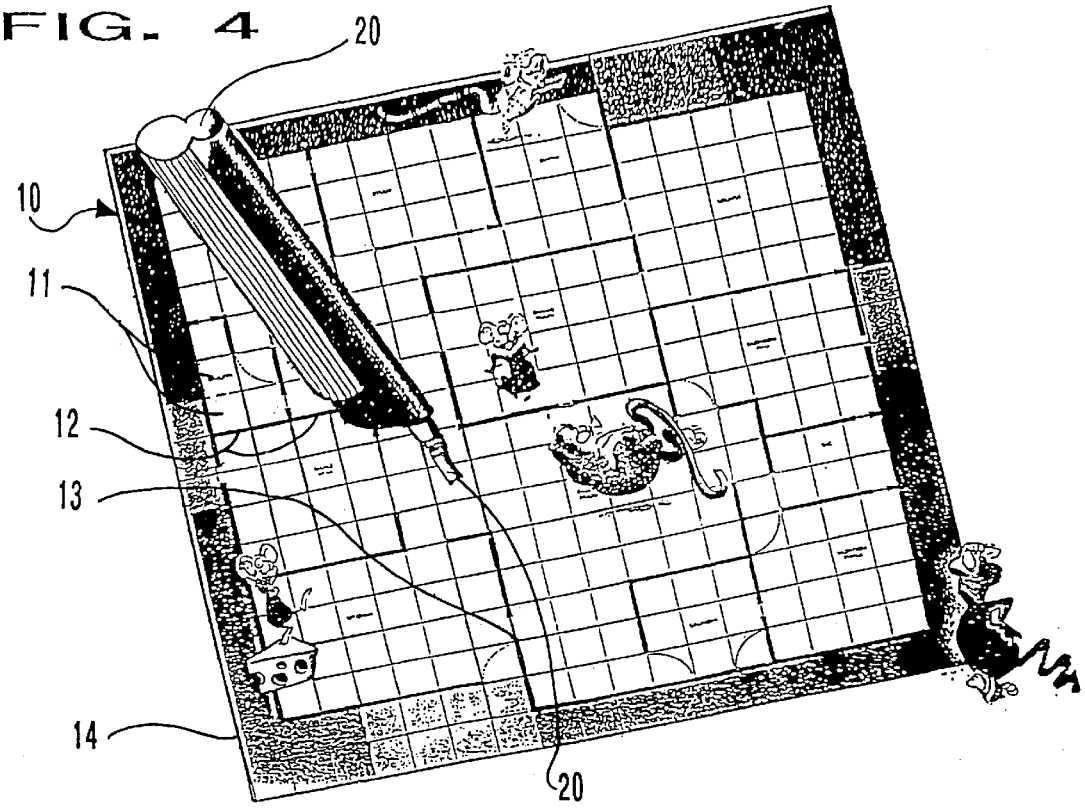
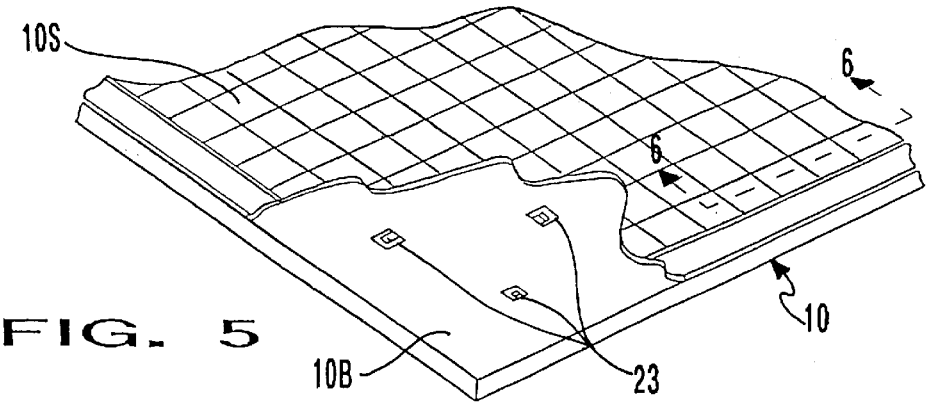
FIG. 5
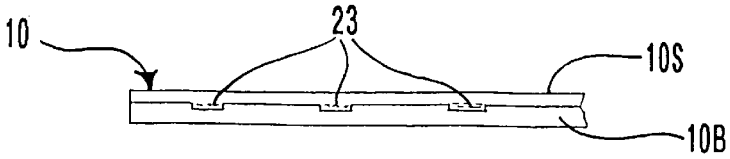
FIG. 6

LED
21
HIT PULSE PROCESSOR
107
DETECTOR
106
AMPLIFIER
105
VARACTOR TUNED OSCILLATOR
35
103
PROBE COIL
100
MIXER
114
8LEV ADJ.
113
8 BIT RING COUNT
112
SCAN OSCILL
111
2SEC. HALT
110
101
108
8 BITS
8 AND GATES
8 OUTPUT SYNCHRONIZED WITH PULSE
102
120
121
122
8LEDS AND SOUND GENER.
LED AND SOUND CONTR.
HIT PULSE
109

30
31
32
33
34
35
36
40

FIG. 19
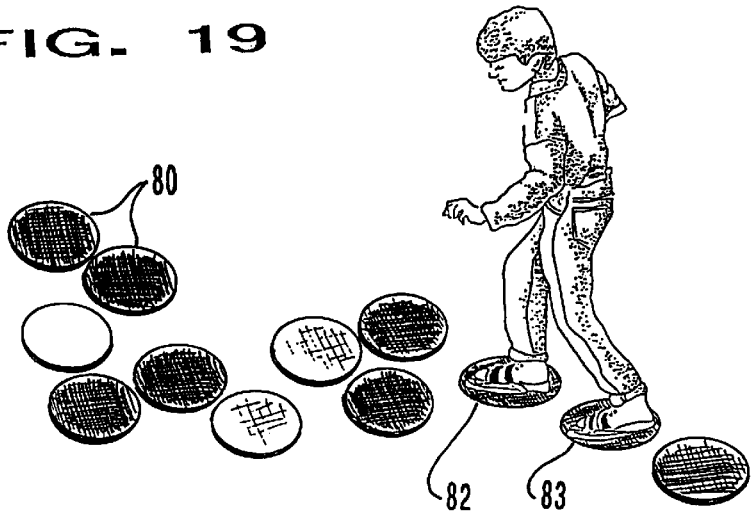
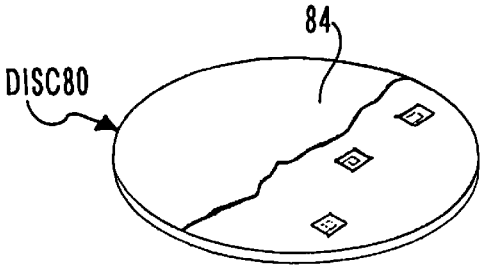
FIG. 20
FIG. 21
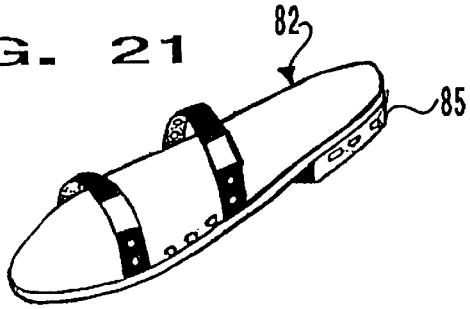
FIG. 22
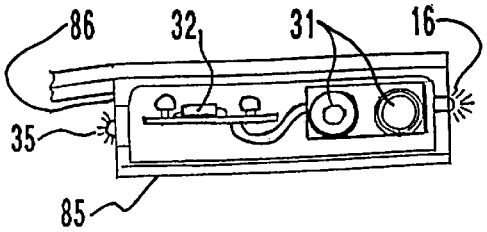

INTERACTIVE PROBE GAME

REFERENCE TO RELATED APPLICATION

This is a continuation of application Ser. No. 08/336,871 filed Nov. 9, 1994, now abandoned.

FIELD OF THE INVENTION

This invention relates to games and particularly interactive games.

BACKGROUND OF THE INVENTION

The field of games to be played primarily by children has been traditionally divided into board and indoor games and outdoor or active games. Recently, with the advent of computers and integrated circuits, there has developed an entire field of video or computer games. Each have their different components and each require a different degree of physical activity on the part of the player. Additionally there are many indoor games which involve some manipulative skills in mechanical games.

Normally, indoor board games include an illustrated playing surface with a number of pieces which are moved in accordance with the game rules with game play usually controlled by a chance device such as a pair of dice or some other random selection device, e.g., a spinner. Outdoor games usually involve a ball or some launched device and possibly a racket or club and depend on more skill of the players than most board games. Randomness in outdoor or field games is often provided by the field or other conditions.

Video or computer games often provide a mixture of player skill and randomness the latter provided by a microprocessor.

Seldom do all three types of games have the same basic game concept or using the same playing equipment.

Recently great interest has arisen in "interactive" games in which the game pattern changes as a result of actions taken by a player or spoken responses by the player.

Nowhere has, to our knowledge, has anyone been able to develop a game concept which becomes a board game, a hand-held or video type game and an outdoor game all with interactive capability.

Some hand held probe like devices have been developed which give an infrared emitter and detector. U.S. Pat. No. 4,604,066 to Frazer et al show such a device. Such a system require the use of special inks on the playing board and the number of responses is limited.

In the field of security devices, complex systems have been developed which sense the presence or absence of a particular device indicating an unauthorized movement of a product carrying the device. These are often used in retail establishments to prevent the shop-lifting of such products. Such systems are typified by the U.S. Pat. Nos. 3,810,172 and 3,766,452 issued to Burpee et al. In the field of games, some detection devices have been developed similar to the security devices which give a positive indication of the presence of a hidden device or no signal in the absence of the device. Nowhere, to our knowledge, has any game type system been able to produce numerous, low cost, easily concealable, and accurately, discrete, identifiable devices and, more important, to have a random or interactive response to the detection of one or more of the devices.

Of further importance is the fact that none of the detection systems are adaptable to board games, hand-held games and outdoor games.

BRIEF DESCRIPTION OF THE INVENTION

We recognized the situation regarding games and the challenge presented by all of the above requirements and have developed a game concept which is suitable for preschool, school age, including teen-age players as well as adults and which may be played in the living room or video game parlor or outdoors. We further recognize that it is possible to develop a game which is, in fact, interactive with the players so that even with increase skill through play, memory will not provide an undo advantage over other players playing it for the first or fewer times.

We have also determined that it is possible to have a totally different theme for a game which employs the same fundamental operational elements and can appeal to other players.

Basically, our invention involves some game board or playing surface which may be decorated either permanently or by movable designs to provide an attractive pattern and theme for the players. Concealed on the board or playing surface are a number of devices which are detectable by the game probe but not detectable visually or by touch or by any of the human senses. In several of the embodiments, the devices are concealed within a board and in others, they are concealed within a game piece having some visual image and the game piece may be placed by the players at any of several places on the game board. In the latter case, even though the playing piece is visible and it is known that it carries a secret device, the player may not know the effect of the secret device on the game play.

The game includes a hand-held or body worn or more generally, movable probe which is moved by the player or players around the playing surface. The probe will sense the presence of the hidden device and will actuate a signal to the players. The signal may be an illuminated light, a musical sound, a command or an audible comment.

The circuitry which responds to the detection of the hidden device is programmed to one of the following:

1. Give the same response for each time it is detected;
2. Provide a random response; or
3. Provide a response which is related to the previous actions of a player or previously detected devices (i.e. interactive).

In one embodiment of this invention is a game board with the devices beneath the playing surface which is ornamented to provide the game theme and to conceal the devices. In another embodiment, the devices are concealed in small movable pieces having a picture or symbol thereon which may be placed on a game board in positions selected by the player. The response, preferably, is related to the picture or symbol.

In another embodiment, the devices are located in various positions on a stepping stone and the probe is carried by special attachment to the shoes of the game player. Other embodiments are clearly possible employing this game concept.

The preferred form of devices are simple printed circuits having a unique design allowing easy, predictable, and reliable detection by an electronic probe. The devices are passive and require no power source.

The probe is preferably battery powered and develops an RF signal which is radiated locally in the specific area under the probe. The probe includes detection circuitry which responds to the presence of the device to indicate a "detect" condition and identify which device is detected. The detector of the probe is coupled to logic circuitry and to a display. The logic circuitry will determine the nature of the response to be given and the display will provide a visual or audible signal to the player. The logic circuitry in the interactive embodiment of this invention includes memory to remember at least the last device detected to modify the response of the next device detected.

In certain applications, it is a requirement that a detectable device be produced on one side of a dielectric sheet such as paper and preferably by a standard printing process. Given this requirement we have found that it is possible to develop such a pattern. Basically the pattern is made up of two sets of interleaved fingers which provide capacitative coupling. The set of fingers are each interconnected with respective buses. The buses are connected to opposite ends of an inductive element forming a single partial turn loop. The inductive portion has a spacing from the fingers of several times the interdigital spacing of the fingers.

BRIEF DESCRIPTION OF THE DRAWING

This invention may be more completely understood from the following detailed description with reference to the drawings in which:

FIG. 4 is a perspective view of a hand-held probe and board game employing this invention with hidden devices integrated into the playing board;

FIG. 5 is a fragmentary perspective view of the board of FIG. 4 with a portion of the playing surface broken away to reveal hidden devices;

FIG. 6 if a vertical section of the embodiment of FIGS. 4 and 5 showing three concealed devices;

FIG. 19 is a perspective view of an outdoor game incorporating this invention being played;

FIG. 20 is a perspective view of a stepping pad of FIG. 19 with a portion broken away to disclose the presence of hidden devices;

FIG. 21 is a perspective view of a sandal incorporating probe sensor therein;

FIG. 22 is a vertical sectional view through the heel of the sandals of FIG. 21 showing the probe assembly therein;

DETAILED DESCRIPTION OF THE INVENTION

Figure 1:
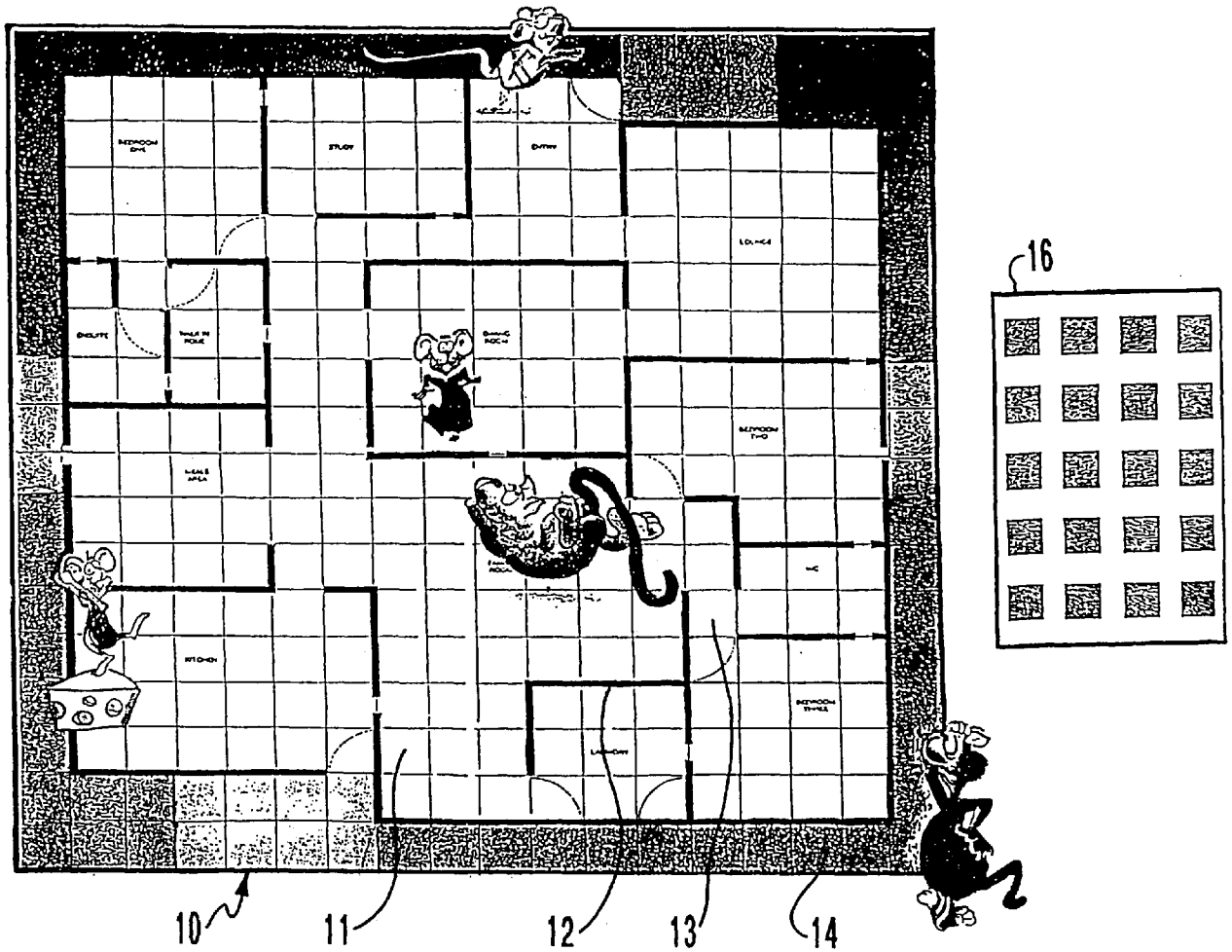
FIG. 1 is a perspective view of a board game employing this invention.
Figure 1:
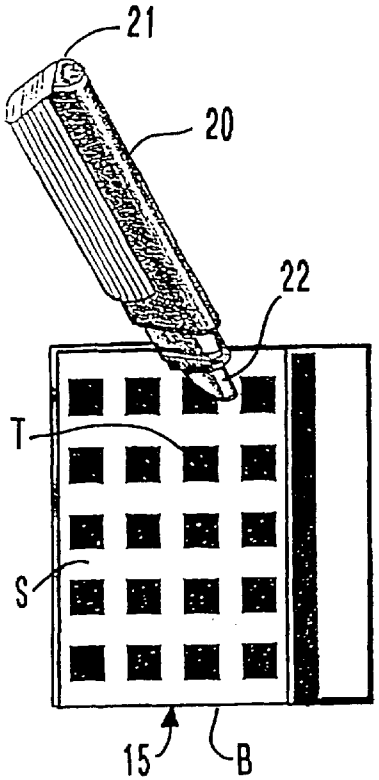
Figure 2:
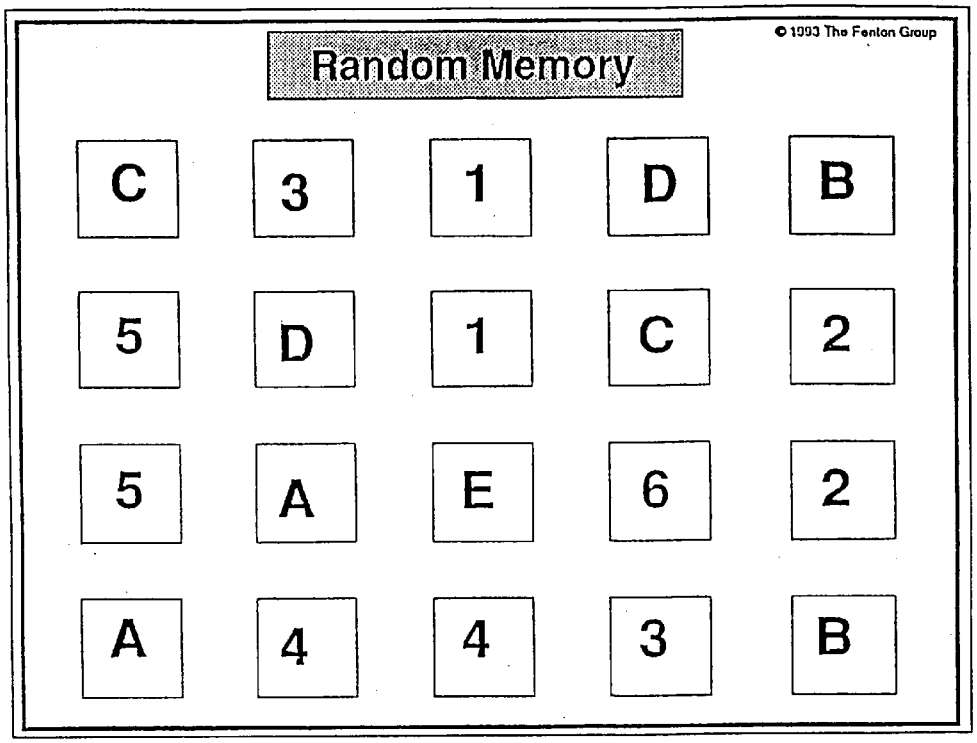
FIGS. 2 and 3 are plan views of the play pads of FIG. 1 showing typical examples of the encoding of the concealed devices employed in the game of FIG. 1.
Figure 3:
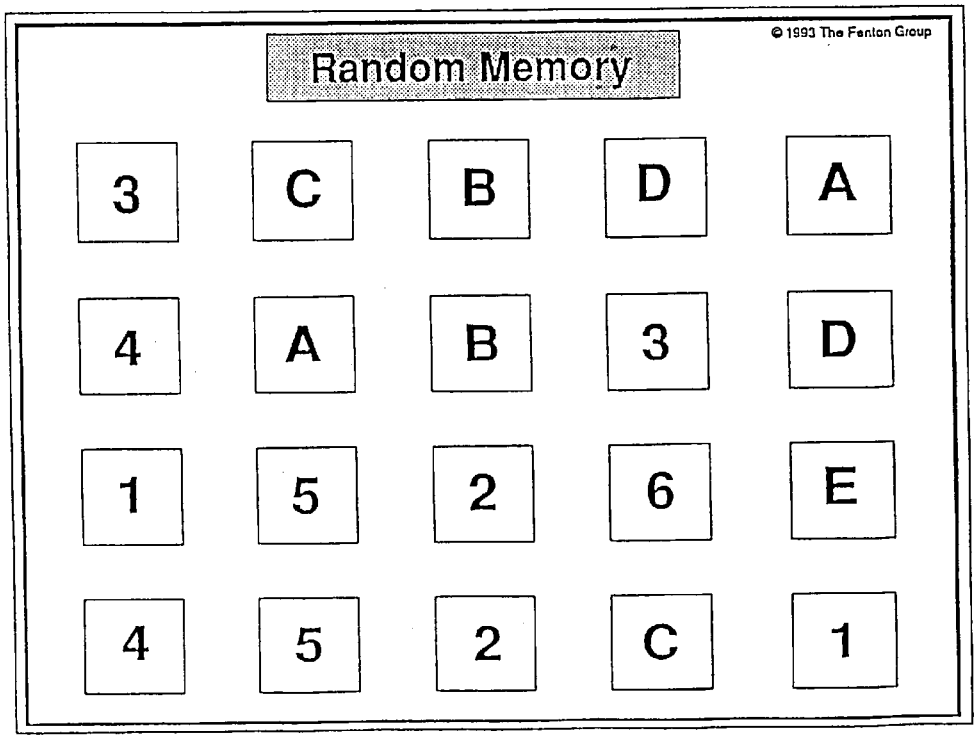
Figures 7, 8:
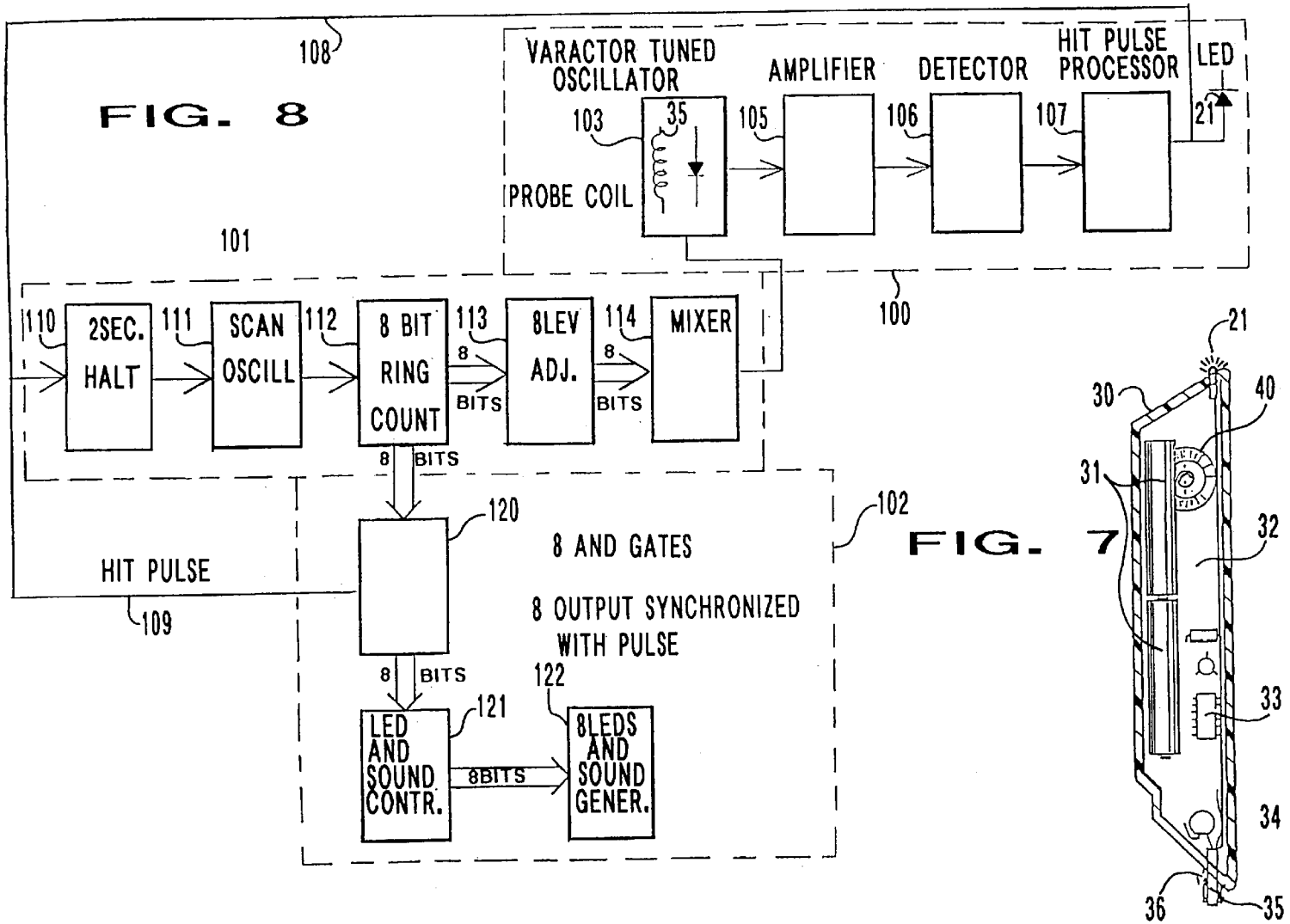
FIG. 7 is a longitudinal sectional view through the probe of FIG. 1.
FIG. 8 is block diagram of the RF circuitry of the probe of FIG. 1.

Now referring to FIG. 1 in connection with FIGS. 2, 3, and 7 wherein a typical game board 10 is shown with a number of playing positions or squares 11 with a number of barriers 12 and a number of passages 13 and an edge border which confines the playing space. In this particular game the barriers define a number of rooms but any type of game pattern may be used in connection with this invention.

A pair of play pads 15 and 16 are shown, one for each player. Poised above the touch pad 15 is a probe 20 which is suitable for indoor play and the probe 20 to be hand held. The probe 20 contains a power supply such as a battery, circuitry as described below which appear in FIG. 7 but are unshown in FIG. 1 and an indicator 21 such as a light emitting diode (LED) or a liquid crystal display (LCD) and a sensor portion 22 which is shown poised above touch pad 15. Concealed below the surface of touch pad 15 are a number of devices 23, unshown in FIG. 1, which are virtually paper thin and located between its surface 10S and its base 10*b*. Typical arrays of devices 23 are shown in FIGS. 2 and 3 and their method of concealment shown in FIGS. 5 and 6. The surface S with its printed pattern located the devices.

The probe 20 detects the presence of devices 23 when the probe sensor 22 is positioned over a touch position T concealing a device 23. Whenever the probe 20 is held such that its sensor 22 is over a playing position lacking a device 23 nothing is sensed and the indicator 21 is not operational. The indicator 22 is illustrated as a lamp or LED, however a sound generator or vibrator may be present in the probe 20 giving an audible or tactile detectable output. The audible indication may be either a voice command or appropriate sound for the particular game.

Typical coded responses are shown in FIGS. 2 and 3 showing either a numerical response 1–6 or a command A–E. Typically, the numerical responses denote number of spaces. The letter commands may be:

A. Lose a turn

B. Exchange board with a player on your left

C. Extra turn

D. Exchange board with a player on your right

E. Go again and double distance

The numerical or other coding is normally different for each card 15 or 16 providing a degree of randomness each time the cards are exchanged. The letter command may change totally with the format of the game. The numerical or letter commands may be given by flashing lights or audibly.

The probe 20, as shown in FIG. 7 contains within its housing 30, a power source such as batteries 31, the required circuit components, generally designated 32, an integrated circuit 33, a varactor diode 34 and a sense coil 35. The sense coil 35 is located in a closed end tube 36. The tube 36 is of a dielectric material as is the housing 30. The tube 36 allows the sense coil 35 to be brought in close or actual contact with the playing surface S while the probe 20 is moved across the touch pad 15.

Extending out of the housing 30 is the indicator 21 with its leads extending into electrical connection with the circuitry contained on the circuit board 32. The indicator 21 is shown on the top of the housing 30 but may be located anywhere on its exposed surface where the game players may see it. Where visual signals are used, indicator 21 may be multiple different colored or physically spaced LEDs or an LCD display visible to all. In the case where audible signals are used, the sound generator 40, located within the housing 30 provides the audible indication.

An alternate embodiment of the game board of FIG. 1 is illustrated in FIGS. 4–6. In this case, detectable devices 23 are concealed in the actual playing surface 10*c* and must be found by the player. Three such devices 23 appear in the broken away portion of FIG. 5 embedded in the base 10*b* of the game board 10 under the playing surface 10S.

Of course, the players will soon learn the location of the devices 23. They will not, however, be able to predict the command which detection of a particular device 23 will produce due to randomness or interactiveness of the response of the probe 20.

Now referring to FIG. 8 where the preferred block diagram of the probe may be seen, the circuitry includes an RF portion 100, a logic portion 101 and an indicator or display portion 102. The RF portion 100 includes a varactor tuned oscillator 103 including the probe coil 35 of FIG. 7. The varactor tuned oscillator 103 has a preferred frequency range of 100 to 250 Megahertz and is controlled from lead 104 from the logic portion 102 by a direct current signal. The voltage is stepped as shown in FIG. 8 to provide virtual sweeping of the frequency of the amplifier 103. The stepped frequency output of the oscillator 103 is amplified in the amplifier 105 detected in detector 104 and LED 21 is powered by hit pulse processor 107 when the sense coil makes a "hit".

Figure 9A:
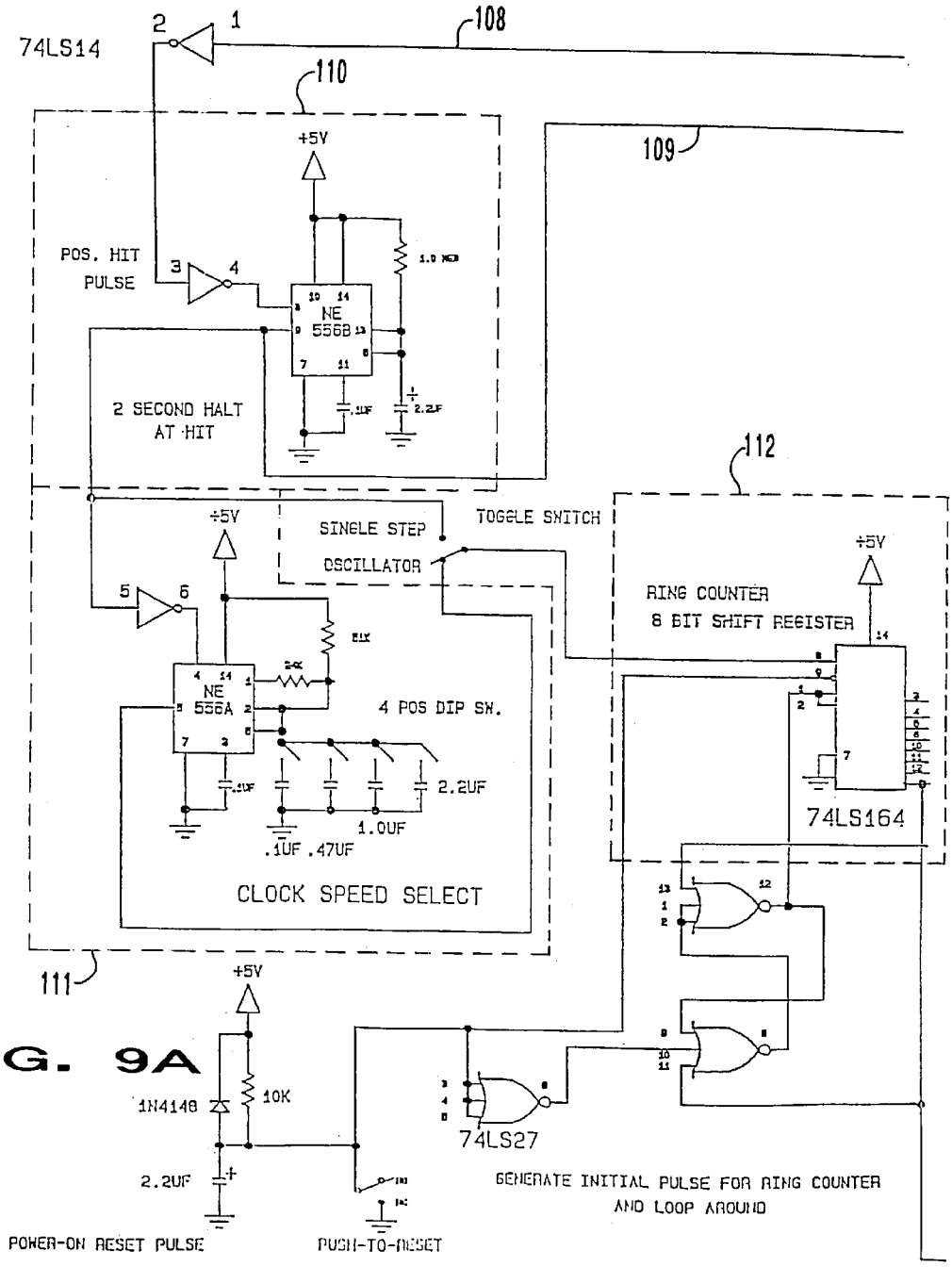
FIG. 9 is electrical schematic drawing of the logic circuitry of the probe of FIG. 7.
Figure 9B:
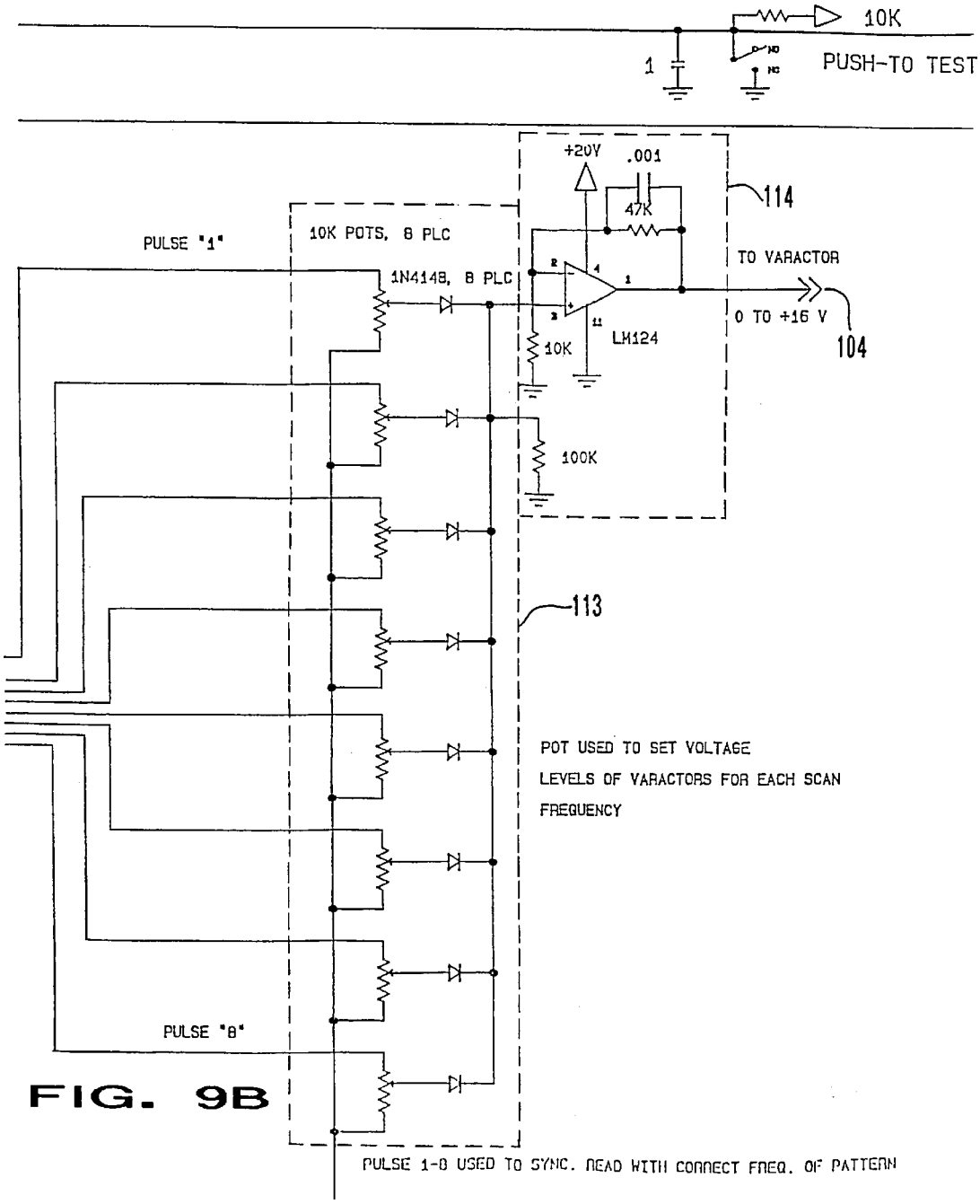
Figure 9C:
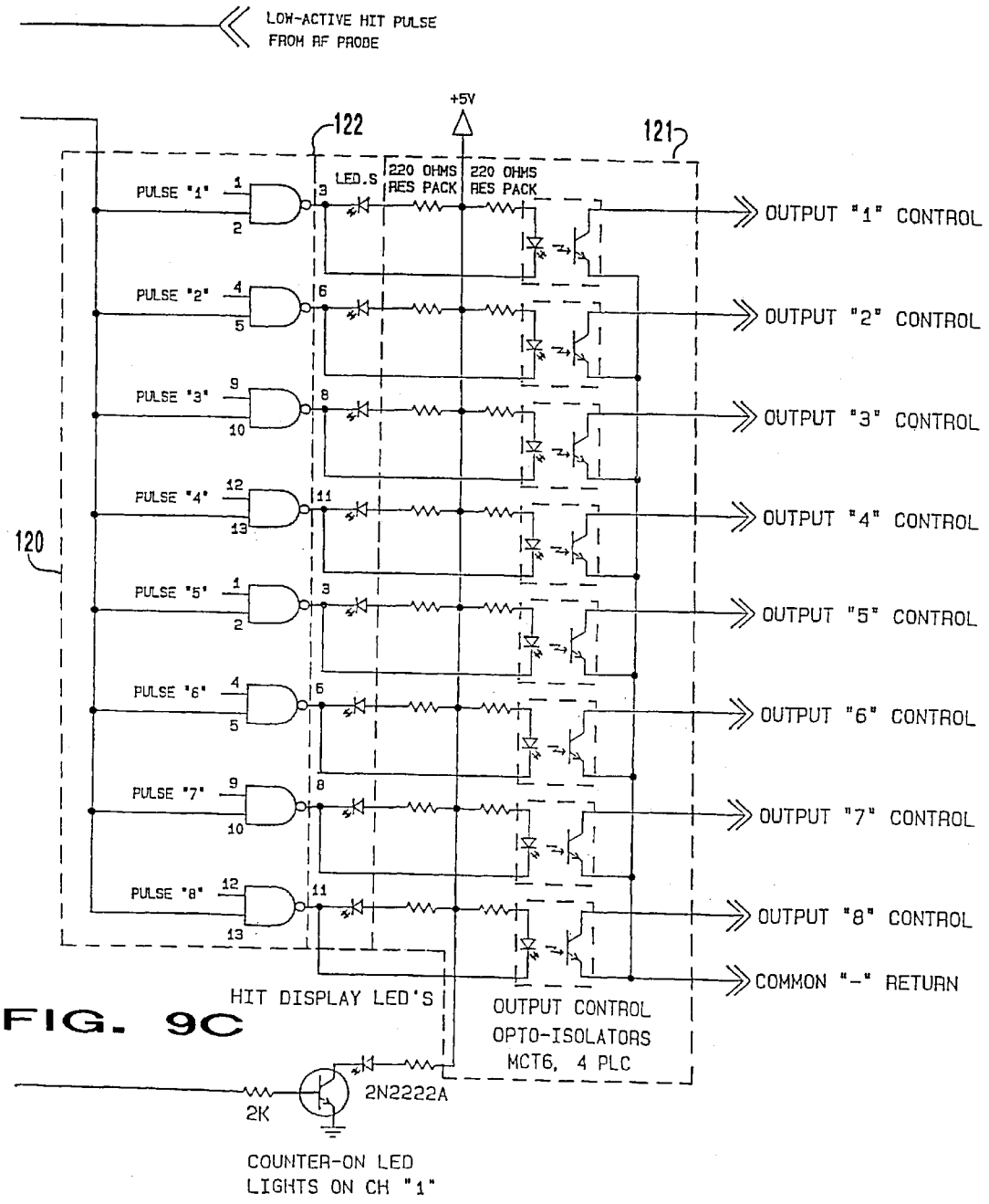

The circuitry of the logic portion 101 and indicator or display portion 102 is shown in FIG. 9. It includes the two second halt timer 110 which is triggered by pulses on lead 108 from the RF portion. After the 2 second pause, the scan oscillator 111 is triggered driving the 8 bit shift register 112 level adjusted in circuit 113 and introduced into mixer 114. The mixed signals are introduced over lead 104 to control AND gates 120 which are operated by a "hit" pulse on lead line 109 and on corresponding pulse 1–8 to trigger the various LEDS 122 and any auxiliary audio output by LED and sound control circuit 121.

Figure 11:
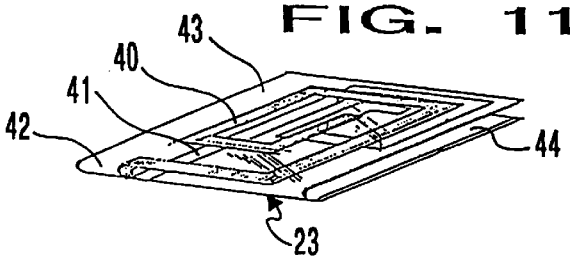
FIG. 11 is an enlarged perspective view of a concealable device of this invention.

Now, reference is made to FIGS. 11 through 14 for an understanding of one form of the devices 23 of FIGS. 5 and 6 and of each of the other embodiments of this invention. The devices 23 are printed circuit coils which may be termed as bifilar when in their finished form shown enlarged in FIG. 11. The devices 23 constitute electrically connected oppositely wound inductive patterns 40 and 41 which are printed on a common strip backing 42 of FIGS. 11–13 on the same side and folded together around a dielectric film 44. The rear face or outer side 43 of the backing layer may carry an adhesive whereby the adhesive lies on both outer surfaces of the device 23 when folded allowing it to adhere to both the playing surface 10s and the base 10*b* of the boards of FIGS. 5 and 6. The devices 23 as shown in FIG. 11 are exaggerated in thickness for clarity but as produced are of such slight thickness that they provide no trace of their presence on the playing surface 10*s*. They are virtually paper thin.

Figure 12:
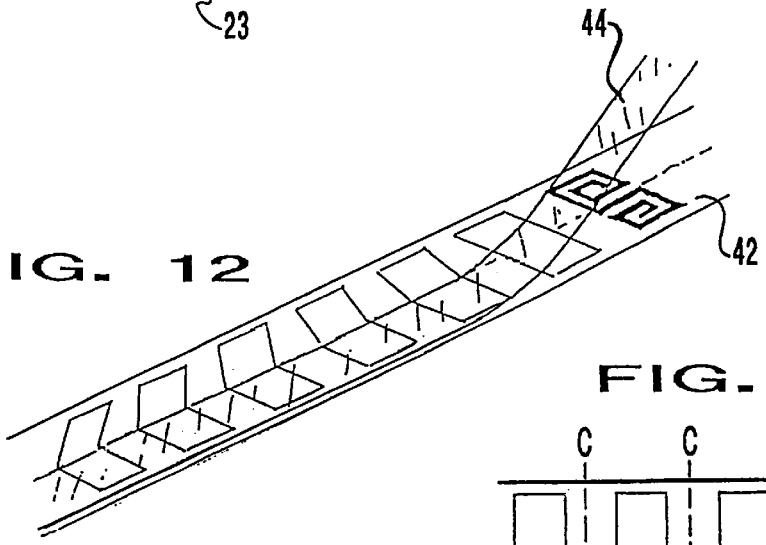
FIG. 12 is a simplified perspective view of a series of devices of FIG. 11 during manufacture.
Figure 13:
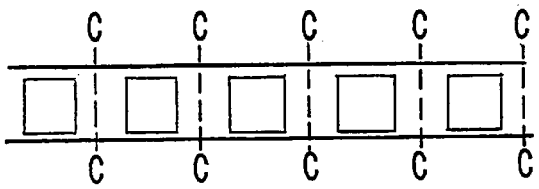
FIG. 13 is a top plan view of the devices of FIG. 12 ready for separation.

The devices 23 are produced in this embodiment by carrying out the process of FIGS. 12 and 13. First, a dielectric strip 42 such as paper or Mylar polyester film is printed on one face with a conductive ink in the double reverse spiral pattern 40 and 41 shown in FIGS. 11 and 12. Next, one of the spiral portions is covered with a dielectric layer 44 which typically is a Mylar polyester film tape. The tape 44 may be adhesively coated on one or both surfaces. Next, the dielectric strip 42 is longitudinally folded as shown in FIG. 12 to a finished strip form as shown in FIG. 13. The individual devices 40 are now separated by transverse cuts along lines C—C of FIG. 13 to form individual concealable, detectable, devices. Where the backing strip 42 has been adhesive coated on one or both sides 43, the devices 23 are ready for installation at any preselected or random portion between the base 10*b* and the playing surface 10*s* of any game board employing this invention.

Figure 14:
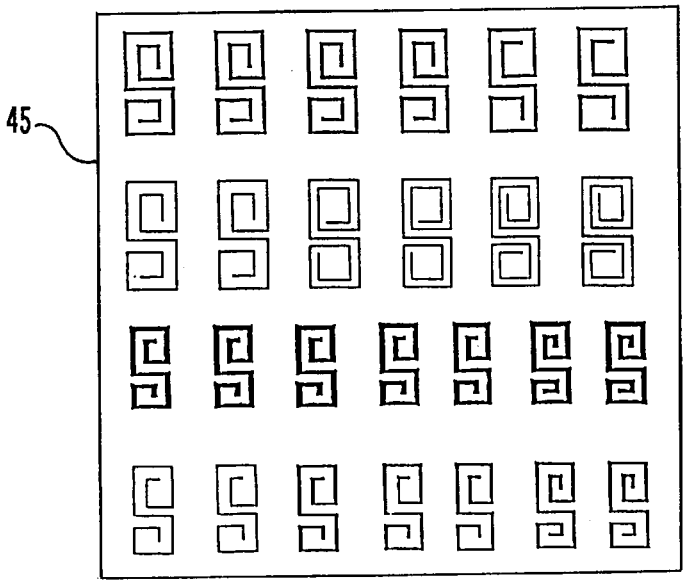
FIG. 14 is a top plan view of a variety of devices of FIG. 11, each with a different response frequency.
Figure 15:
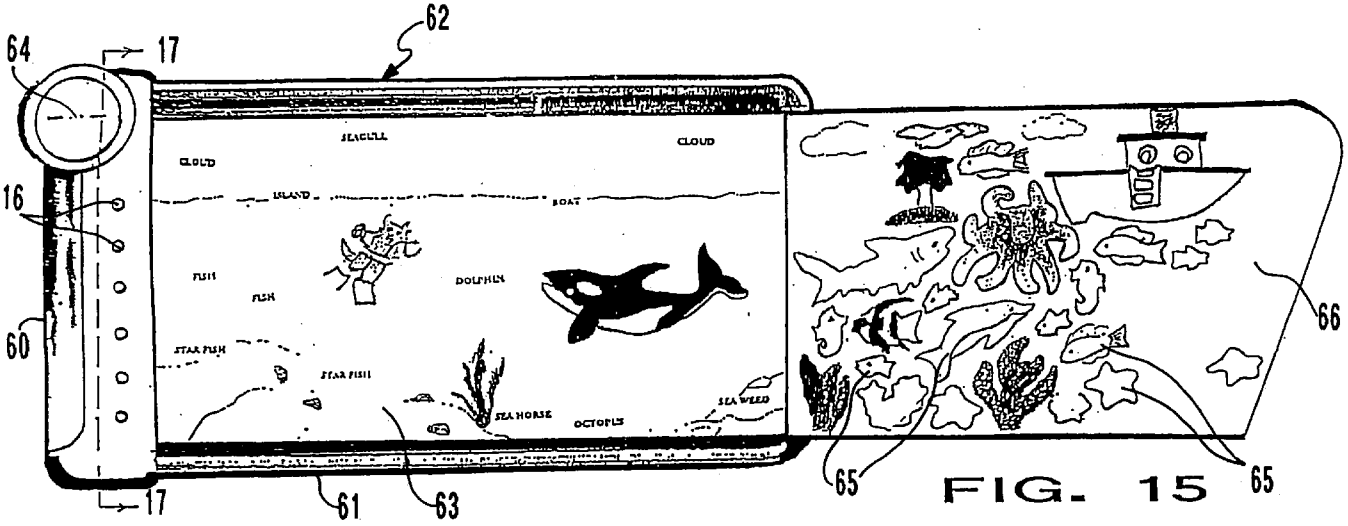
FIG. 15 is a top plan view of a hand held interactive game in which multiple probe sensors are secured within the game body and in which interchangeable game pieces each have a concealed device therein giving a unique response.
Figure 18:
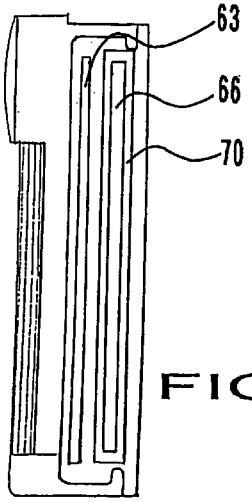
FIG. 18 is a right end view of the game of FIG. 15.
Figure 17:
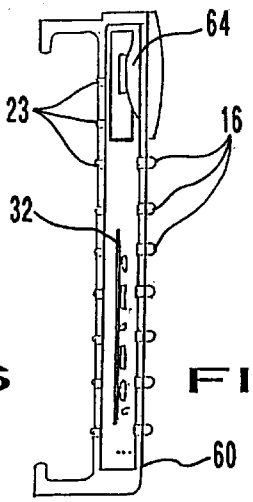
FIG. 17 is a vertical sectional view of the embodiment of FIG. 15 taken along line 17—17 thereof.
Figure 16:
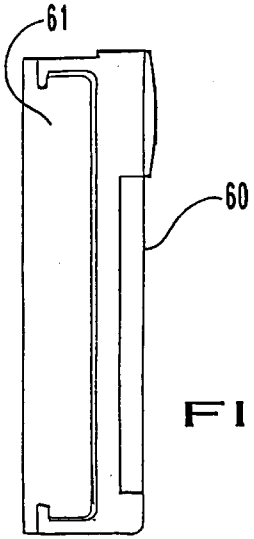
FIG. 16 is a left end view of the game of FIG. 15.

The devices 23 may also be produced in sheet form as illustrated in FIG. 14. Sheets 45 of backing are printed in a number of different patterns as illustrated in FIG. 14. The patterns are similar but each respond to a different frequency. The frequencies in megahertz are indicated above each device. The dielectric overlay may be in strip or form 49 covering either one spiral or both spirals of each individual device.

Note in FIG. 14 that each of the patterns of the devices 21 have similar patterns but have different line width and line length. These differences are sufficient to provide different response curves for each different pattern with a different center frequency and high enough Q to allow as many as 16 different detectable responses by the probe 20 and therefore enhances the play value of whichever game format is used.

Given the capability of being adaptive, as described below, depending upon the order of devices 40 detected, play value is further enhanced. Although the player may remember that a device 23 is concealed at a particular playing position such as position 11 in FIG. 1, the player does not know whether that device will provide him with a favorable or unfavorable response signal the next time he detects it with probe 20.

Now referring to FIGS. 15–18, a hand held game form of this invention is shown therein employing multiple sensors of the type present in the probe 40 of the previous embodiments, but in this case, the sensors are located in a bridge-like structure 60 which extends across a frame 61 of a hand-held game generally designated 62. The game 62 includes a play surface 63 having a background such as an underwater marine scene. The bridge 60 is laterally movable across the playing surface 63 to scan for the presence of any concealed devices 40. Each of the sensors 35 which are contained in the underside of the bridge are connected to the circuitry on circuit board 32 which will illuminate visual indicators such as LEDs 16 or a LCD display whenever the sensor passes over a concealed device 40. Audible signals may be produced by a loud speaker on the bridge 60.

In the embodiment, the concealed devices are each present in small stick-on images 65 such as vinyl which, for example, may depict a marine animal. In this case, the concealed device 40 is selected to trigger a sensor 35 and to give a response which is related to the marine animal. Contained within the circuitry in the bridge, or partly in the bridge or the sound generator operated under the control of the sensors gives an appropriate message emitted by loud speaker 64. The stickers 65 are kept on a sheet 66 which is stored in slot 70 in the right hand end of body 61. The sheet 66 may be pulled out, stickers 65 selected and placed on the surface 63. The bridge 60 is moved by the player over the surface 63 and as each device is detected, a visual indicator 16 is illuminated or an appropriate message is displayed on a LCD and an appropriate audible message is reproduced by the loud speaker.

In basic play, the loud speaker gives the name of the marine animal.

In more complex play, information about the marine animal is given orally.

In adaptive play, a message is reproduced which is appropriate for the combination of stickers detected on a single passage of the bridge.

The same basic probe circuitry is employed in this embodiment as in previous embodiments with the exception that there are multiple sensors located in the movable "probe bridge" so that multiple detections can occur on a single passage. In the simplest form, each sensor, when it detects a particular concealed device will give a standard message. In employing adaptive logic, a different message can be given depending upon the sequence or type of devices which are detected. For example, if mackerel fish are detected in the presence of sharks, the message may be related to a warning to the mackerel. If, however, a dolphin shows up, the dolphin can protect the mackerel. In this form, not only can the smallest youngsters learn the different marine animals, additionally, the children may learn the relationship between different marine animals so the device becomes not only entertainment, but educational, as well. For example, if the sensor detects a device 40 in a mechanical sticker it may say:

"Hello, Mr. Mackerel."

If a shark is next detected, it may say:

"Danger, a shark."

If a dolphin is next detected, it may say:

"Mr. Dolphin, chase that shark away and save Mr. Mackerel."

All of these messages are stored in Read Only Memory (ROM) chip and the logic circuitry determines which messages beyond the basic message is audibly reproduced. Employing this combination, the player learns the appearance, name, and characteristics of a particular animal and its relationship to other residents of the marine environment. With different stored messages and different stickers, a totally different game may be produced, e.g., forest animals, astronomy, geography or any environment desired. The importance of this last feature is illustrated in the game embodiment of FIGS. 19 through 22. This is an example of an outdoor or yard game embodying this invention. The playing surface is the yard or sidewalk. The game pattern is made up of a number of discs 80 which the players may place at will on the yard or playing surface in any order or arrangement which they like as long as the discs 80 are within player striding distance of each other. A player P wears one or two sandals 82 or slip-on attachments 83 on his shoes or bare feet. The sandals or attachments 82 or 83 contain a footwear version of the manually held probe 20 of FIGS. 1 and 7.

Concealed within the discs 80 under the walking surface or cover 84 are a number of devices 40 positioned in a random pattern. There may be as few as one device 40 in a disc 80 or as many as six or eight as is appropriate for the game. The only real limitation is that the devices 40 should be placed from each other that only one will be detected at one time when the player places his foot on a disc 80. A practical minimum device 21 spacing is two inches in a twelve inch disc designed particularly for children's play.

The probe 20 of FIG. 1 has been reconfigured to mount in or on the sandal 82 or a shoe attachment. In this case the probe assembly is located in the hollow heel 85 which contains the sense coil 35 in the front wall 86 of the heel 85. The batteries 31 and the circuit board 32 as well as a display 86 or sound generator 90 are all shown in the heel 85. The sense coil 84 need only be in the proximity, (e.g., ½ inch) of a device 40 to sense a device 21 and to activate the visual display 86 or to energize the sound generator 90. The visual display 86 may be on the heel 85 or preferably connected by concealed wires to one of the straps 91 where the indicator 40 may be readily seen by all players. Typical voice commands or messages in this version of the game are:

LOSE A TURN

STAND ON YOUR RIGHT FOOT

GO BACK TO START

TAKE 2 STEPS FORWARD

YOU'RE THE WINNER

Figure 10A:
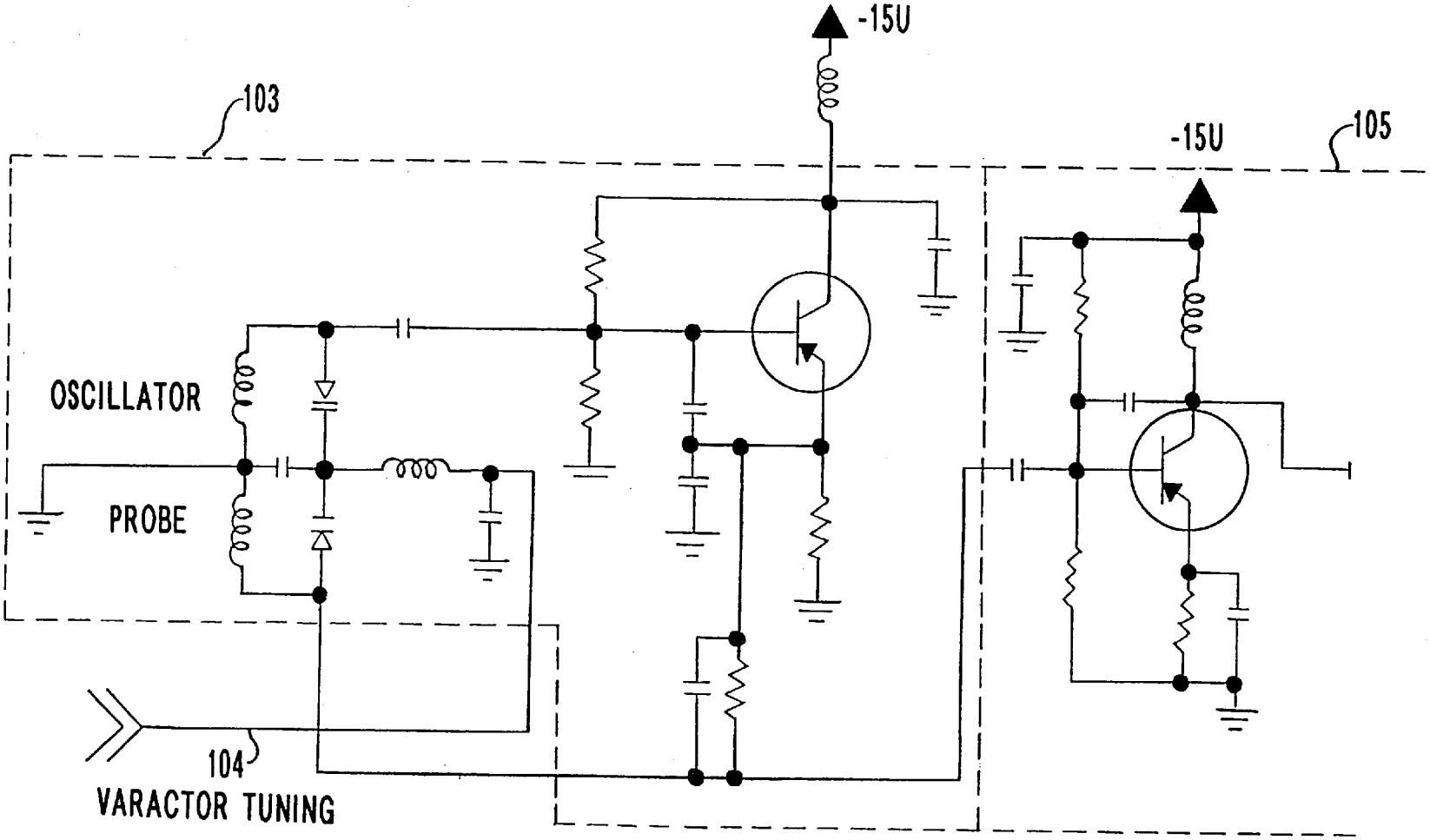
FIG. 10 is a electrical schematic of the output signal stage of this invention.
Figure 10B:
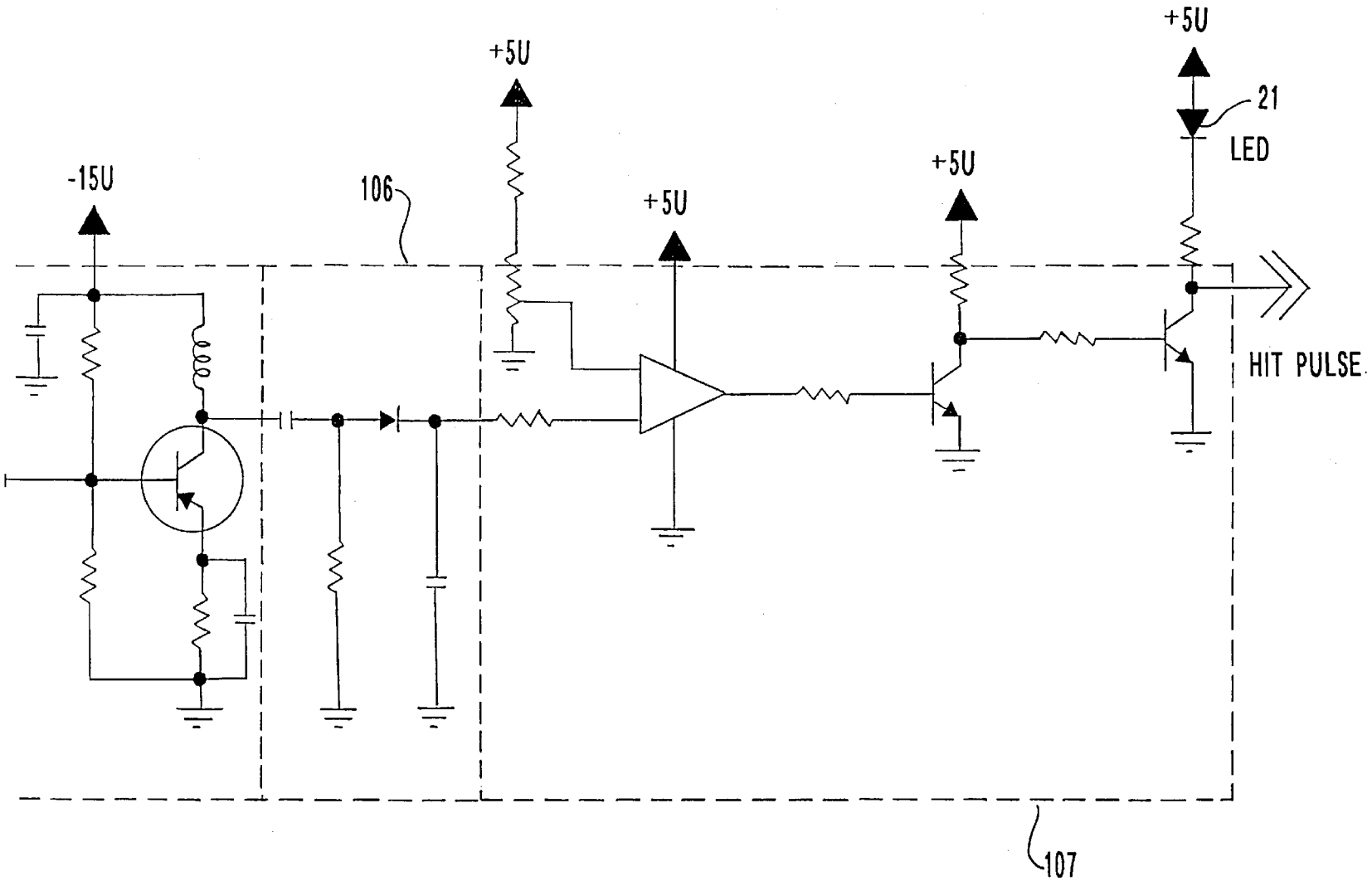
Figure 23A:
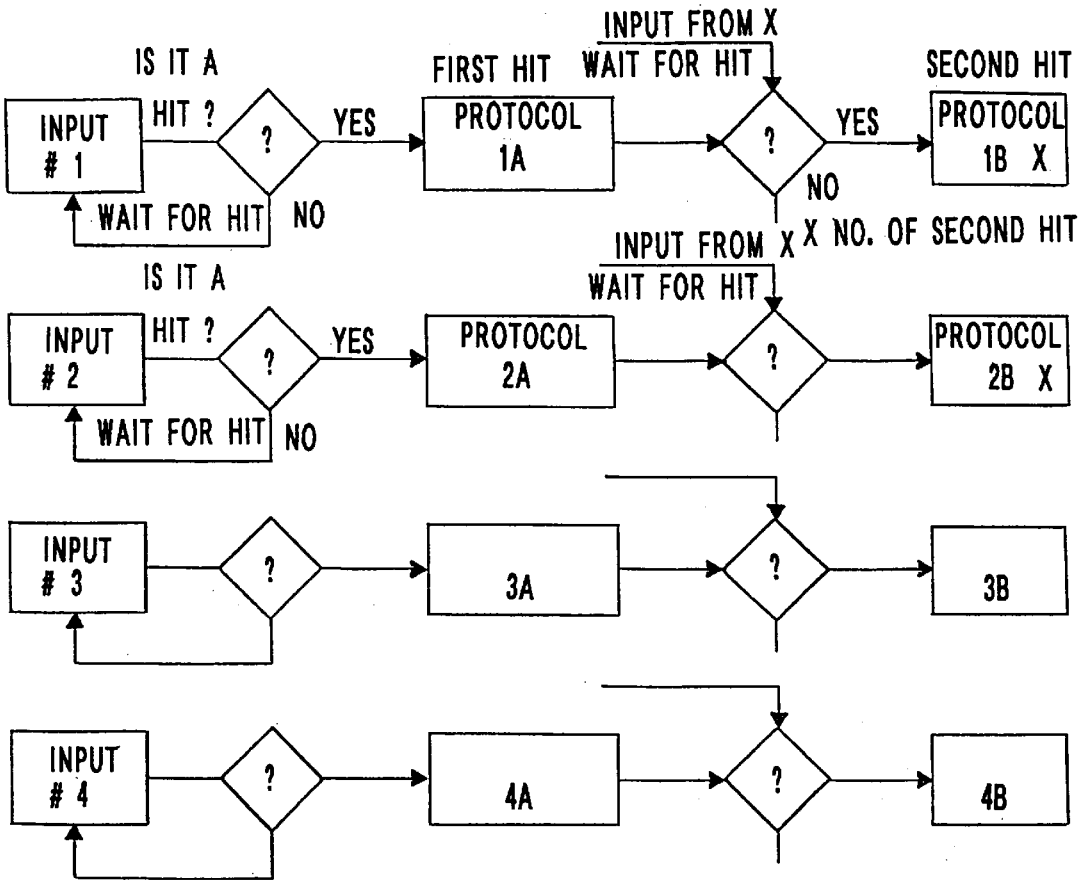
FIG. 23 is a flow diagram of the interactive version of this invention.
Figure 23B:
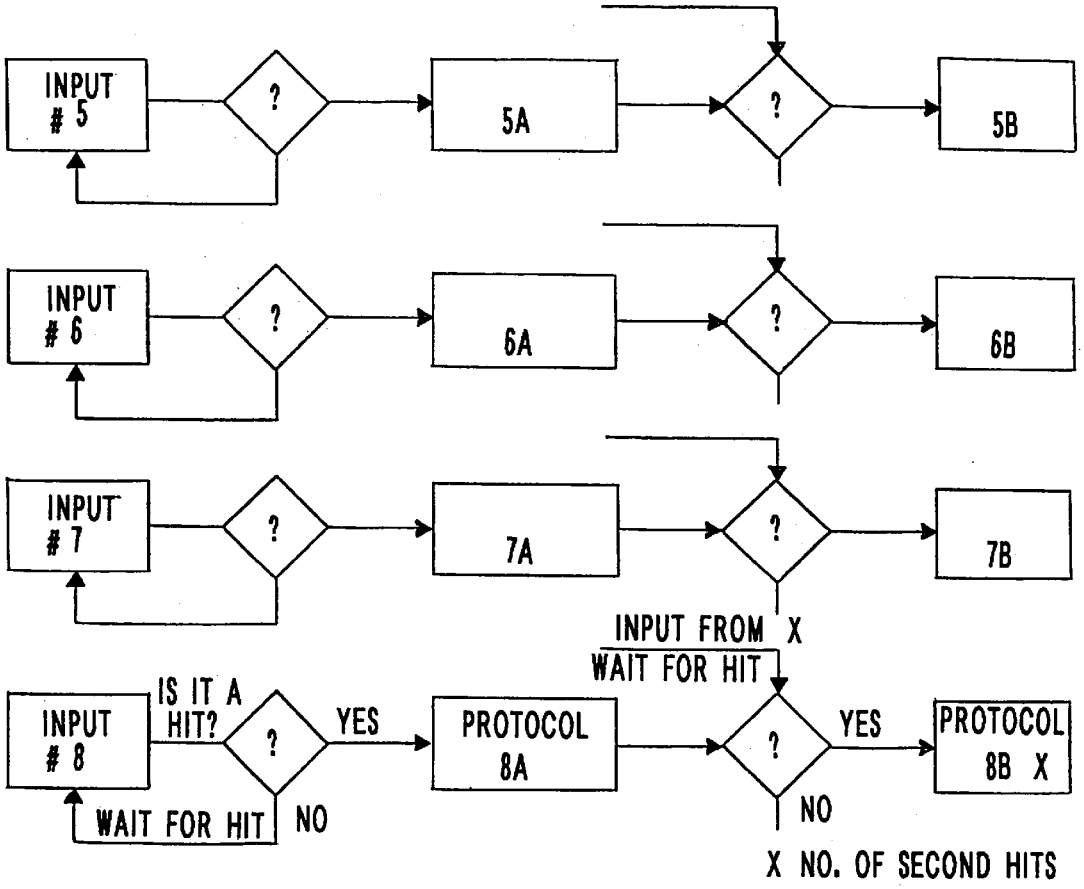

FIG. 23 is a flow chart for the interactive version of this invention in which sequence of "hits" or detection of devices by the probe in any game embodiment produces a different response. In the example of FIG. 23, eight different devices are used identified as inputs #1–#8 for illustration purposes. The detector of FIGS. 8 and 10 determine whether there is a "hit" and which of the devices has been detected by correspondence with the hit pulse on lead 109 and the ring counter output of FIG. 8. When a first "hit" occurs indicating an input #1, protocol 1A is initiated. A protocol is a predetermined course of action or event such as game status, an instruction, reward, a penalty, verbal and sound generation, limited only by the imagination and ingenuity of the game designer.

When a second "hit" occurs, the number of the second hit determines the second protocol which is the result of the players interaction. When a second "hit" occurs after an initial hit has occurred on device #1, protocol 1B+x response. X is the number of the second "hit". Thus, the response for each different sequence will change.

Figure 24:
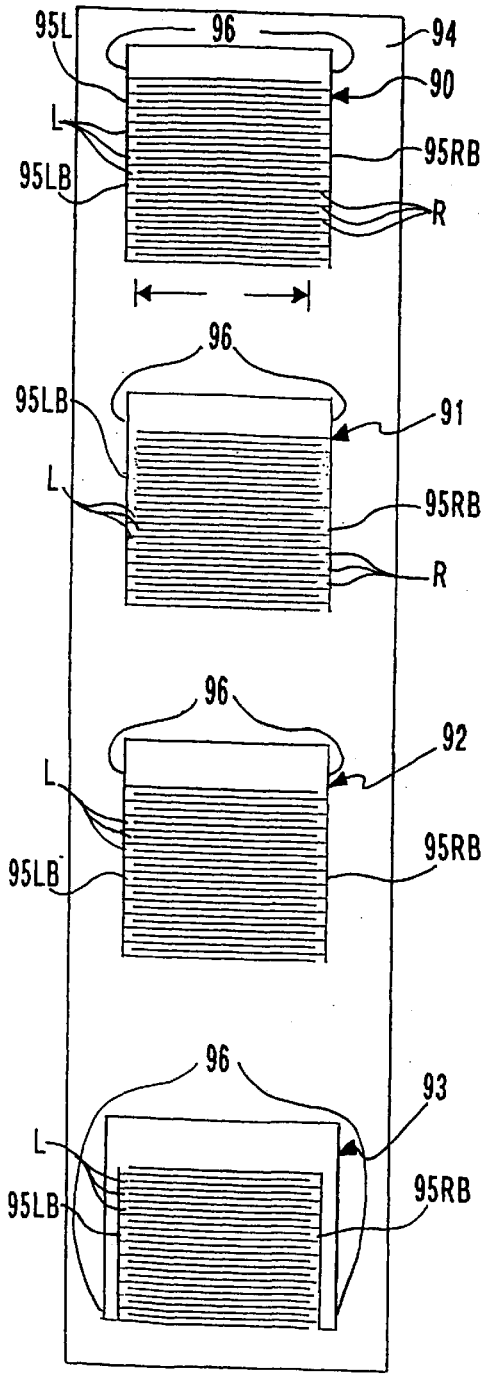
FIGS. 24 A through D are top elevational views of single layer detectable devices.

Now referring to FIGS. 24 A–D which shows four examples 90–93 of devices deposited on a single side of a paper backing 94 and each have a distinct resonant frequency which are each individually detectable and distinguishable from each other by the probe of FIGS. 1, 7 and 8. The backing may be paper.

Each of the four examples 90–93 include respective sets of conductive fingers F having a line width, for example, in the order of 0.015 to 0.025 in. and a length, for example, of ⅞ to 15/16 in. with a line spacing in the order of a line width. The interleaved portions I are approximately 90% of the finger F lengths. Each set of fingers, labelled L and R, for convenience, are connected to a respective common bus 95L and 95R which are electrically connected by loop portion 96 which provides the principal inductance of the device.

The patterns 90–93 which we used have an overall area of approximately 1 square inch. This size is not critical and larger or smaller sizes may be used with a resultant change in resonant frequency. The pattern was silk screened printed on high gloss coated 110 lb. paper with a silver conductive ink, type E 82-05 of the Colonial Ink Co. The ink was deposited as described below and cured by heating to printed backing to 125 degrees F. for a period of three minutes to provide a reliable bond to the paper and a series of devices which may be covered or coated by any concealing (nonconductive) layer and separated to constitute a series of concealed detectable devices. Each device 90–93 are identifiable and distinguished by their different resonant frequency. The same patterns may be printed on any press capable of depositing and drying conductive ink.

In the examples shown in FIG. 24, device 90 responds at a center frequency of approximately 183 MHz to the presence of probe 20 of FIGS. 1, 7 and 8 while the example of FIG. 24 D exhibits a resonant center frequency of approximately 220 MHz. The intermediate examples 91 and 92 have intermediate center frequencies. The differences between the examples 90, 91, 92 and 93 are principally the results of the extra length of the inductive loop 96 as is represented by the added spacing between the side of the inductive loop and the capacitative finger F array. Note, that in the example 90 which exhibits the lowest center frequency in this group the inductive loop is connected to the opposite ends of the busses 95L and 95R thereby doubling the length of the inductive loop 95 as compared to the examples 91, 92 and 93. A useful frequency range, at present, is 100–250 Megahertz although further developments in technology can all allow higher frequencies which would have the added advantages of smaller devices and increased number of distinguishable patterns.

Figure 25:
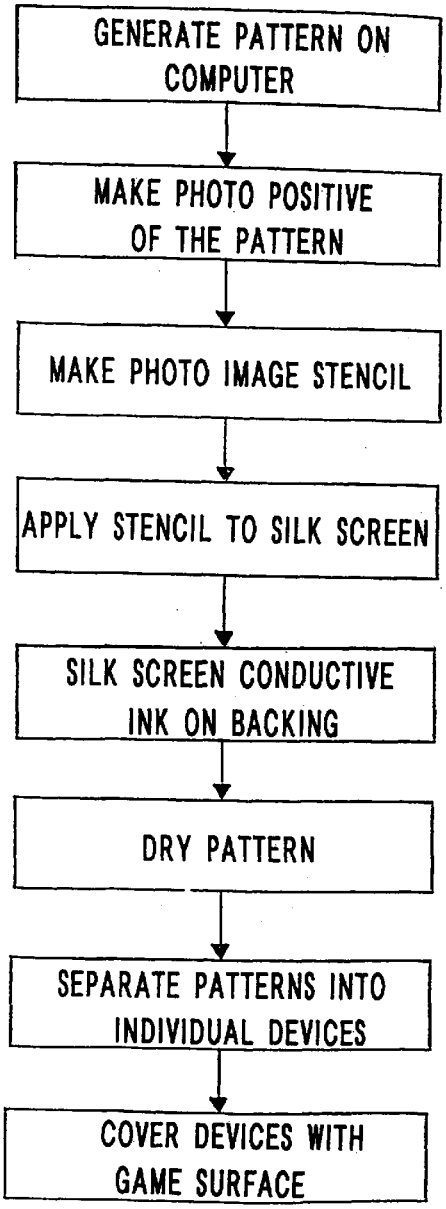
FIG. 25 is a flow diagram of the process used to produce the patterns of FIG. 24.

The basic process which we used providing the working prototype is shown in FIG. 25.

This silk screen process consists of a number of steps:

1. The pattern is generated on a computer aided design (CAD) system.

2. A Gerber file (a well known database used in photo plotting) is made which is then photo-plotted to produce a positive film of the pattern. This is an extremely accurate and conventional process with an accuracy of 0.001 inch.

3. The film is photo-imaged onto a stencil which can be used to make the silk screen, (actually a fine wire mesh).

4. The paper backing 94 is placed on a flat surface with a stenciled screen above. Next conductive ink placed on the screen and a rubber roller squeezes the conductive ink through the stenciled pattern and the ink is then deposited on the paper or plastic surface 94.

5. The ink that we are using will air dry at room temperature in about 15 to 20 minutes or will cure in 3 minutes at 125 degrees F. The drying time is used to boil out the solvents in the ink, at that time, it becomes conductive.

For production printing, the process is simplified and the ink dries in the normal movement from the press to cutting and stacking stage.

For convenience, this pattern has been produced employing well known silk screen pattern processes however the pattern may also be produced by conductive material vapor deposition on paper or by producing a thin metal foil pattern, and bonding it to a paper or other backing.

The above described embodiments of the present invention are merely descriptive of its principles and are not to be considered limiting. The scope of the present invention instead shall be determined from the scope of the following claims including their equivalents.

What is claimed is:

1. A radio frequency electromagnetic energy responsive device comprising:

a generally planar dielectric substrate;

a generally rectangular conductive pattern on said substrate;

said conductive pattern including:

a first array of elongated conductive fingers each having a proximal end and a distal end;

a first conductive bus at a first side of said generally rectangular conductive pattern interconnecting the proximal one end region of each of said first array of elongated conductive fingers together;

a second array of elongated conductive fingers each having a proximal end and a distal end and in spaced interleaved relationship with said first array of elongated conductive fingers;

a second conductive bus at a second and opposite side of said generally rectangular conductive pattern from said first conductive bus and interconnecting the proximal end region of each of said second array of elongated conductive fingers;

conductive means at one end of said first and second arrays of elongated conductive fingers interconnecting said first and second conductive busses together at a third side of said generally rectangular shape and spaced from said elongated fingers by a distance greater than the spaced relationship of adjacent interleaved elongated fingers of said first and second array;

said first and second conductive busses and connecting conductive means together constituting the principal inductance of said device.

2. A radio frequency electromagnetic energy responsive device in accordance with claim 1 wherein each of said elongated conductive fingers are substantially equally spaced and said first and second arrays constitute the principal capacitance of said device.

3. A radio frequency electromagnetic energy responsive device in accordance with claim 1 wherein each of said elongated conductive fingers are straight and define a substantially rectangular array.

4. A radio frequency electromagnetic energy responsive device in accordance with claim 1 wherein said first and second conductive buses are located at opposite edge of said conductive pattern.

5. A radio frequency electromagnetic energy responsive device in accordance with claim 1 wherein said interconnecting conductive means is spaced several times greater than the spacing of adjacent fingers of said first and second array.

6. A radio frequency electromagnetic energy responsive device in accordance with claim 1 wherein said conductive pattern is generally rectangular in shape with two sides defined by said first and second buses, a third side defined by one of said fingers and the fourth side of the generally rectangular shape defined by said interconnecting conductive means.

7. A radio frequency electromagnetic energy responsive device in accordance with claim 1 wherein said substrate is principally of cellulosic material.

8. A radio frequency electromagnetic energy responsive device in accordance with claim 1 wherein said conductive pattern is a printed circuit.

9. A radio frequency electromagnetic energy responsive device in accordance with claim 1 wherein said conductive patterns are foil.

10. A radio frequency electromagnetic energy responsive device in accordance with claim 1 wherein the outermost fingers of said first and second arrays, said busses and said interconnecting conductive element constitutes sides of said generally rectangular overall shape.

11. A radio frequency electomagnetic energy responsive device in accordance with claim 1 wherein said busses extend beyond said one end of said array and wherein the resonant frequency of said device is a function of the length of said busses beyond said one end of said arrays.

* * * * *